United States Patent [19]

Rassmann et al.

[11] 4,189,187

[45] Feb. 19, 1980

[54] MINERAL MINING PLANER HAVING PIVOTED FLOOR CUTTER CARRIER

[75] Inventors: Christoph Rassmann, Lunen; Willy Heyer, Bochum-Gerthe; Heinrich Wildforster, Gelsenkirchen-Buer, all of Fed. Rep. of Germany

[73] Assignee: Gewerkschaft Eisenhütte Westfalia, Lunen, Fed. Rep. of Germany

[21] Appl. No.: 909,857

[22] Filed: May 26, 1978

[30] Foreign Application Priority Data

Jun. 23, 1977 [DE] Fed. Rep. of Germany ..... 2728178

[51] Int. Cl.[2] ..... E21C 27/32

[52] U.S. Cl. ..... 299/34; 299/85

[58] Field of Search ..... 299/32, 34

[56] References Cited

U.S. PATENT DOCUMENTS

| | | | |
|---|---|---|---|
| 3,245,722 | 4/1966 | Creuls et al. | 299/34 |
| 3,343,879 | 9/1967 | Grisebach | 299/34 |

FOREIGN PATENT DOCUMENTS

| | | | |
|---|---|---|---|
| 281317 | 2/1965 | Australia | 299/34 |
| 2360766 | 12/1975 | Fed. Rep. of Germany | 299/34 |

*Primary Examiner*—Ernest R. Purser

*Attorney, Agent, or Firm*—Sughrue, Rothwell, Mion, Zinn and Macpeak

[57] ABSTRACT

A mineral mining installation for winning material in a mineral mining working comprises a plough and a plough guide. The plough has a plough body movable along the plough guide, and the plough body is provided with a carrier for floor cutters. The carrier is mounted on the plough body for movement relative thereto and is supported and guided on a surface of the plough guide.

11 Claims, 3 Drawing Figures

MINERAL MINING PLANER HAVING PIVOTED FLOOR CUTTER CARRIER

BACKGROUND TO THE INVENTION

This invention relates to an installation for winning material from a mineral face in a mine working. The invention is particularly concerned with a plough for use in mining coal.

Known coal ploughs are arranged to be driven along a guide which is provided at the coal face side of a conveyor such as a scraper-chain conveyor. Such a plough is provided with a loading ramp for loading the won coal onto the conveyor. Passages are provided, behind the guide, for the endless plough drive chain. On the mine floor, the guide has a floor plate which forms a slide path for the plough and which also serves to limit the depth of cut of the plough. For this purpose, the arrangement is such that the plough cutters project, to an extent equal to the required depth of cut, beyond the front edge of the guide, that is to say of its floor plate, this edge being pressed against the coal face to be won.

In known coal ploughs, the cutters adjacent to the mine floor perform the function of carrying out a cut of predetermined depth in the floor zone immediately in front of the front edge of the floor plate, this cut being utilised for control or stress-relieving purposes. Since the plough has to be moved along its guide with a relatively large amount of play, and as the floor cutters are arranged on the body of the plough, each movement of this body relative to the guide necessarily leads to a change in the position of the floor cutters during their cutting action. Obviously, this is undesirable and can result in operational difficulties. In particular, when hard coal is being won, if the floor cutters are advanced too far, a considerable increase in the tensile forces in the plough chain will occur which may even cause the plough to become jammed.

SUMMARY OF THE INVENTION

The present invention provides a mineral mining installation for winning material in a mineral mining working, the installation comprising a plough and a plough guide, the plough having a plough body movable along the plough guide, and the plough body being provided with a carrier for floor cutter means, wherein the carrier is mounted on the plough body for movement relative thereto and is supported and guided on a surface of the plough guide.

In this installation, the carrier is mounted to be freely movable relative to the plough body in such a way that, under the effect of the reaction forces from the face being won, it is pressed, without play, against the support and guide surface on the plough guide. This ensures that the required depth of cut by the floor cutters does not vary during any movement of the plough body relative to the guide that might occur owing to play in the guiding action. Thus, the position of the floor cutters during cutting is substantially determined by the position of the guide itself, and not by the position of the plough body relative to the guide, which position varies within the range of the play, this result being achieved despite the fact that the carrier is mounted on the plough body.

Advantageously, said guide surface is positioned adjacent to the floor of the mining working, and preferably, the carrier is pivotally mounted on the plough body about a pivot pin whose axis lies substantially parallel to the face to be won and in the longitudinal direction thereof, whereby the carrier is able to execute pivoting movements, relative to the plough body, towards and away from the face. This pivotal mounting of the carrier permits the floor cutter means to be adjusted automatically in the required manner.

Preferably, said guide surface is an end-face edge of the guide that is presented to the face to be won. In this case, said end-face edge may be provided on a floor plate which forms part of the plough guide and which forms a slide track for the plough.

Advantageously, the pivot pin of the carrier is disposed substantially vertically above said guide surface, and preferably the pivot pin is disposed substantially at the level of the top edge of a conveyor to which the guide is, in use, attached.

Preferably, said end-face edge of the plough guide is slightly inclined with respect to the level of the floor of the mining working, and the carrier has an inclined rear surface which, in use, is slidably supported and guided thereon.

Advantageously, said guide surface is provided with replaceable wear resistant elements.

The carrier may be mounted on the plough body substantially centrally thereof. Moreover, the pivot pin of the carrier may be adjustably mounted on the plough body for movement in the vertical direction and/or in the direction towards and away from the face to be won. This enables the carrier (and hence the floor cutter means) to be positioned accurately.

The invention also provides a mineral mining plough for winning material in a mineral mining working, the plough comprising a plough body which, in use, is movable along a guide, the plough body being provided with a carrier for floor cutter means, wherein the carrier is movable relative to the plough body and is provided with a surface which, in use, is supported and guided on the plough guide.

BRIEF DESCRIPTION OF THE DRAWINGS

One form of coal plough constructed in accordance with the invention will now be described, by way of example, with reference to the accompanying drawings, in which.

DESCRIPTION OF PREFERRED EMBODIMENT

Figure 1:
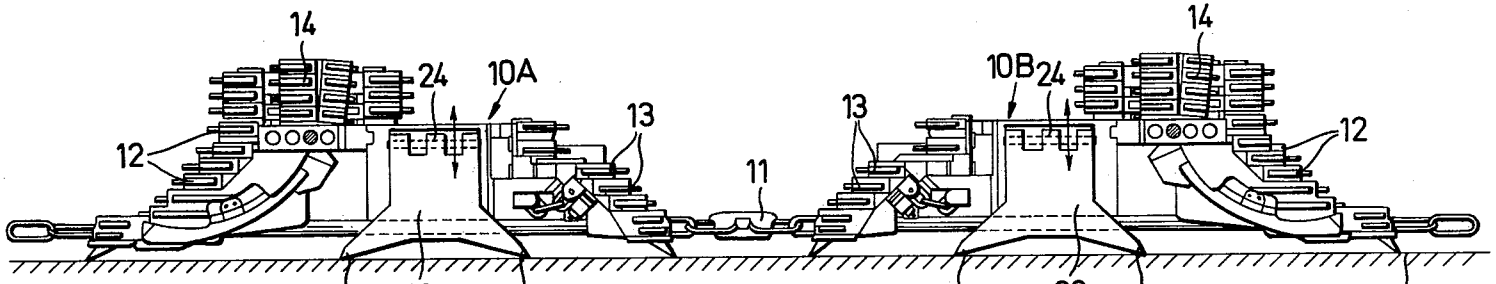
FIG. 1 is an elevation of the plough as seen from the face being won.

Referring to the drawings, the plough consists of two plough bodies 10A and 10B which are flexibly joined together by a chain section 11. At their mutually adjacent and mutually remote ends, the two plough bodies 10A and 10B are each provided with cutters 12 and 13 respectively, which are arranged in echelon formation one above the other. Each of the cutters 12, 13 is relatively narrow and is removably mounted in a carrier. Where the plough is to be used to win coal from thick seams, the plough bodies 10A and 10B are provided with upper cutters 14.

The entire plough is positively guided on a guide 15 which is attached to a scraper-chain conveyor 16 on the coal face side thereof. As is usual, the guide 15 has two oppositely disposed channels 18 and 19 for the endless chain (not shown) which is used to drive the plough to and fro along the guide. These channels 18 and 19 are located behind an inclined plate 17 of the guide 15. The return run of the plough drive chain is guided in the upper channel 18 and the traction run of the chain, to which the plough is connected, is guided in the lower channel 19. For the purpose of connecting the plough drive chain to the plough, the two plough bodies 10A and 10B have guide arms 20 which extend into the lower channel 19 and thus establish connection with the traction run of the drive chain. The guide 15 is provided with a floor plate 21 which forms a slide track for the plough. The two plough bodies 10A and 10B are therefore positively guided on the floor plate 21 as well as on the inclined guide plate 17. As is usual, the guide 15 is formed in sections which correspond to the sections of the conveyor 16.

Each cutter body 10A and 10B is provided with a respective carrier 22 each of which is equipped with two floor cutters 23, one floor cutter of each carrier being operative in a particular direction of travel of the plough. Further cutters may be provided on the carriers 22. The carriers 22 are mounted on respective pivot pins 24 to pivot freely on the corresponding plough bodies 10A and 10B. The pivot pins 24 extend parallel to the coal face and in the direction of movement of the plough (that is to say the longitudinal direction of the face). Thus, the carriers 22 are mounted on their plough bodies 10A and 10B so as to pivot towards, and away from, the coal face. The floor cutters 23, which are removably mounted at the ends of their carriers 22, carry out a control or stress-relieving cut to a depth S at the floor level 25 and immediately in front of the front, coal face, side edge 26 of the floor plate 21. This edge 26 has a guide and abutment surface 27 which is inclined in relation to the floor 25, and against which each of the carriers 22 (or the cutters mounted thereon) is slidably supported by way of a correspondingly inclined rear surface 28. Thus, during the winning operation, the carriers 22 are pressed, without play, by the reaction forces from the coal face against the guide and abutment surface 27, and this ensures that the cutters 23 automatically retain their predetermined cutting depth S when the plough bodies 10A and 10B are moved along the guide 15, even though these bodies may execute horizontal movements, within a given range of allowable play, towards and away from the coal face. Thus, the carriers 22 bear against, and are supported firmly by, the guide and abutment surface 27 irrespective of the above-mentioned transverse play of the plough. The danger of the cutters 23 operating at an excessively large cutting depth, particularly when hard coal is being won, which might lead to jamming of the plough against the coal face, is safely prevented in this way.

Figure 3:
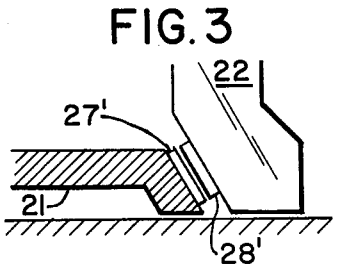
FIG. 3 is an enlarged view of the lower right-hand corner of FIG. 2.
Figure 2:
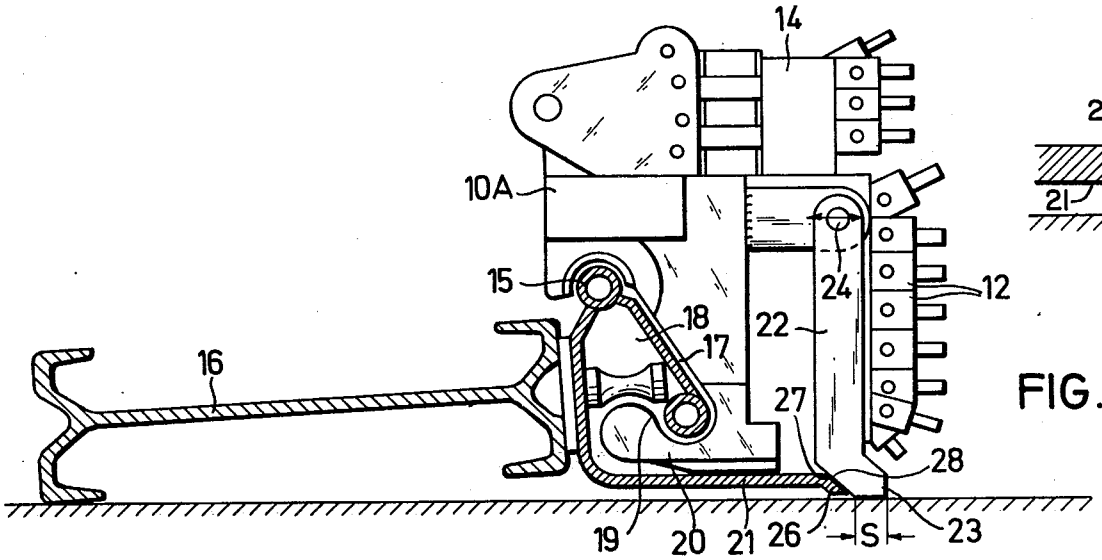
FIG. 2 is a transverse cross-section of the plough of FIG. 1.

The pivot pins 24 are arranged vertically above the guide and abutment surface 27 (see FIG. 2) and are located at a relatively large distance above the mine floor 25. The pivot pins 24 are positioned approximately at the level of the upper apical surface of the inclined plate 17 of the guide 15 or at a slight distance above this surface. Wear plates 27' and 28', made of wear-resisting material, may be removably fitted on the surfaces 27 and 28 that slide relatively to one another as shown in FIG. 3. It is also possible to mount the carriers 22 on the plough bodies 10A and 10B in such a way that their pivot pins 24 can be adjusted both vertically and horizontally towards and away from the coal face, as schematically shown by the double tipped arrows in FIGS. 1 and 2.

In the embodiment described above, the floor plate 21 constitutes the means for limiting the depth of cut of the plough, the cutters 12, 13 and 23 each projecting forwardly of the front edge 26 of the floor plate by an extent corresponding to the required depth of cut of that cutter.

We claim:

1. A mineral mining installation for winning material in a mineral mining working, the installation comprising: a plough and a plough guide, the plough having a plough body movable along the plough guide, and the plough body being provided with a carrier for floor cutter means, the carrier being pivotally mounted on the plough body about a pivot pin whose axis lies substantially parallel to the face to be won and in the longitudinal direction thereof, the carrier being supported and guided on a guide surface of the plough guide, said guide surface being positioned adjacent to the floor of the mining working and being constituted by a face-side end-face edge of a floor plate which forms part of the plough guide and which forms a slide track for the plough, the carrier being positioned substantially centrally of the plough body, and the pivot pin being disposed substantially vertically above said guide surface.

2. An installation according to claim 1, wherein said pivot pin is disposed substantially at the level of the top edge of a conveyor to which the guide is, in use, attached.

3. An installation according to claim 1, wherein said end-face edge of the plough guide is slightly inclined with respect to the level of the floor of the mining working, and the carrier has an inclined rear surface which is slidably supported and guided thereon.

4. An installation according to claim 1, wherein said guide surface is provided with replaceable wear resistant elements.

5. An installation according to claim 1, wherein said pivot pin is adjustably mounted on the plough body for movement in the vertical direction.

6. An installation according to claim 1, wherein said pivot pin is adjustably mounted on the plough body for movement in the direction towards and away from the face to be won.

7. A mineral mining installation for winning material in a mineral mining working, the installation comprising: a plough and a plough guide, the plough having a plough body movable along the plough guide, and the plough body being provided with a carrier for floor cutter means, the carrier being pivotally mounted on the plough body about a pivot pin whose axis lies substantially parallel to the face to be won and in the longitudinal direction thereof, the carrier being supported and guided on a guide surface of the plough guide, and said pivot pin being adjustably mounted on the plough body for movement in the vertical direction and in the direction towards and away from the face being won.

8. An installation according to claim 7, wherein said guide surface is positioned adjacent to the floor of the mining working.

9. An installation according to claim 7, wherein said guide surface is an end-face edge of the guide that is presented to the face to be won.

10. An installation according to claim 9, wherein said end-face edge is provided on a floor plate which forms part of the plough guide and which forms a slide track for the plough.

11. A mineral mining installation for winning material in a mineral mining working, the installation comprising: a plough and a plough guide, the plough having a plough body movable along the plough guide, and the plough body being provided with a carrier for floor cutter means, the carrier being pivotally mounted on the plough body about a pivot pin whose axis lies substantially parallel to the face to be won and in the longitudinal direction thereof, the carrier being supported and guided on a guide surface of the plough guide, said guide surface being positioned adjacent to the floor of the mining working and being constituted by a face-side end-face edge of a floor plate which forms part of the plough guide and which forms a slide track for the plough, said pivot pin being disposed substantially vertically above said guide surface, the carrier being mounted on the plough body substantially centrally thereof, and said pivot pin being adjustably mounted on the plough body for movement in the vertical direction and in the direction towards and away from the face to be won.

* * * * *